United States Patent [19]

Walsh et al.

[11] 4,437,082

[45] Mar. 13, 1984

[54] APPARATUS FOR CONTINUALLY UPGRADING TRANSFORMER DIELECTRIC LIQUID

[75] Inventors: Edward J. Walsh; Robert A. Kurz, both of Hermitage, Pa.

[73] Assignee: Westinghouse Electric Corp., Pittsburgh, Pa.

[21] Appl. No.: 397,288

[22] Filed: Jul. 12, 1982

[51] Int. Cl.[3] ..... H01F 27/10

[52] U.S. Cl. ..... 336/58; 336/57; 336/94; 174/14 R; 174/15 R

[58] Field of Search ..... 336/57, 58, 94; 174/14 R, 15 R

[56] References Cited

U.S. PATENT DOCUMENTS

| | | | |
|---|---|---|---|
| 2,340,898 | 2/1944 | Race | 174/14 |
| 2,505,581 | 4/1950 | Unger | 174/14 |
| 2,718,709 | 9/1955 | Ford | 34/9 |
| 2,985,706 | 5/1961 | Dobry | 174/14 |
| 3,009,124 | 11/1961 | Narbut | 174/15 R X |
| 3,866,460 | 2/1975 | Pearce, Jr. | 73/19 |
| 3,894,171 | 7/1975 | Kusay | 174/14 R |
| 4,058,373 | 11/1977 | Kurz et al. | 55/16 |
| 4,124,834 | 11/1978 | Walsh | 336/58 |
| 4,129,501 | 12/1978 | Haynes | 210/23 R |
| 4,234,754 | 11/1980 | Edwards et al. | 174/14 R |

OTHER PUBLICATIONS

IBM Technical Disclosure Bulletin; P. W. Ing.; vol. 13, No. 5, Oct. 1970, p. 1048; "Self-Cooling Heat Exchanger-Condenser".

*Primary Examiner*—G. P. Tolin
*Assistant Examiner*—Susan Steward
*Attorney, Agent, or Firm*—L. P. Johns

[57] ABSTRACT

Electrical inductive apparatus having a tank, an insulating and cooling liquid in the tank and an electrical winding structure immersed in the liquid, the liquid having a low vapor pressure and containing contaminants derived from various sources within the tank. Filter means associated with the liquid including a liquid recirculating device for degassing, demoisturizing, and filtering insoluble particles out of the liquid, whereby the liquid is decontaminated and upgraded in a continual process.

9 Claims, 2 Drawing Figures

APPARATUS FOR CONTINUALLY UPGRADING TRANSFORMER DIELECTRIC LIQUID

BACKGROUND OF THE INVENTION

1. Field of the Invention

This invention relates in general to electrical apparatus and, more particularly, to apparatus for continually upgrading transformer dielectric fluids by degassing, demoisturizing, and filtering of the fluid.

2. Description of the Prior Art

During the operation of a transformer, the dielectric fluid used for cooling becomes contaminated with water, gases, and insoluble particles, which adulterate the fluid and lead to an increasingly inefficient operation of the transformer. For that reason it is desirable to remove the contaminants either periodically or continuously as required.

Current equipment for upgrading transformer oils on a continuous basis requires many moving parts, such as pumps, and vacuum chambers, which require frequent maintenance and considerable space. Accordingly, there has been a need for more satisfactory means for continually upgrading the dielectric fluid with a minimum of maintenance.

SUMMARY OF THE INVENTION

It has been found in accordance with this invention that problems inherent in prior filtering means for upgrading dielectric fluid may be overcome by providing apparatus for continually upgrading such fluids comprising a tank, a dielectric fluid having a low vapor pressure disposed in the tank, a contaminant in the fluid, and an electrical winding immersed within the fluid in the tank. Filter means are also associated with the tank for decontaminating the fluid including a fluid recirculating device for degassing, demoisturizing, and filtering insoluble particulates out of the liquid, whereby a decontaminated fluid is returned into the tank.

The advantages of the apparatus of this invention are that such a device takes advantage of new technology to perform equivalent functions with only minimal pumping, or no mechanical pumping, and with a reduction in equipment size, and at a significant cost reduction.

DESCRIPTION OF THE PREFERRED EMBODIMENT

Figure 1:
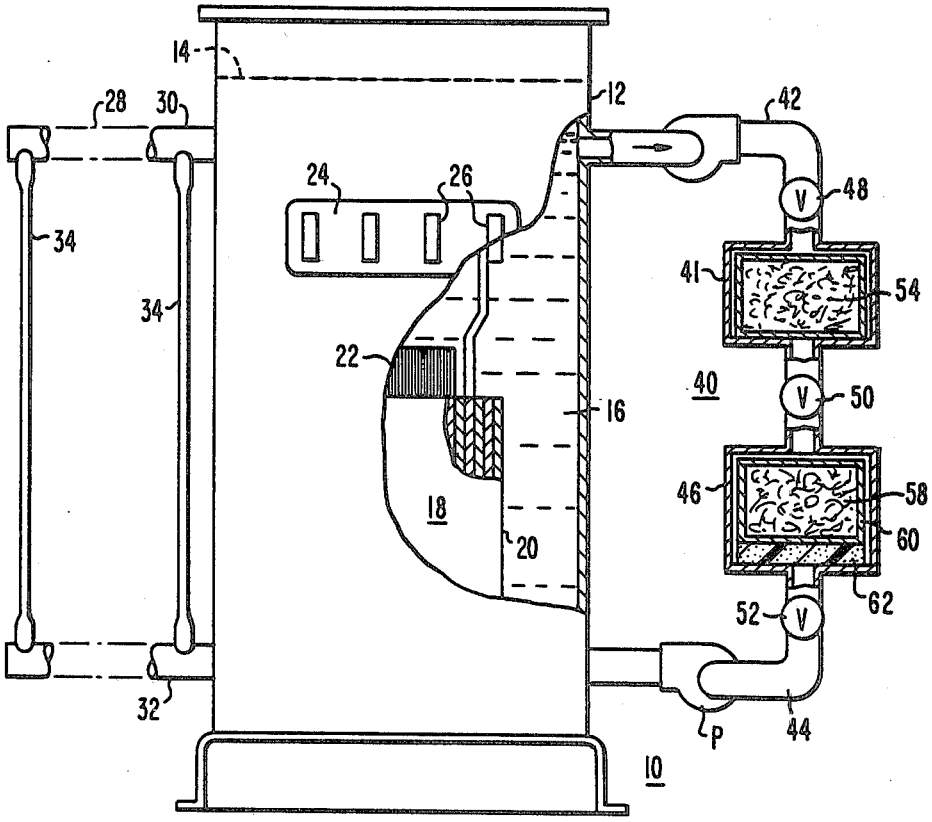
FIG. 1 is an elevational view, partly in section, of electrical inductive apparatus in accordance with this invention.

FIG. 1 illustrates electrical inductive apparatus 10, such as an electrical power transformer, which includes a tank 12 that is filled to a level 14 with an insulating and cooling dielectric liquid or fluid having a low vapor pressure. The liquid 16 is preferably a liquid selected from a group consisting of mineral oil, silicone liquid (such as Dow Corning 561), higher molecular weight hydrocarbons, and mixtures thereof.

An electrical winding-magnetic core assembly 18, having at least one electrical winding 20 disposed in inductive relation with the magnetic core 22, is located in the tank and immersed in the liquid 16. In a typical construction, the electrical winding-magnetic core assembly 18 has high voltage bushings (not shown) adapted for connection to a source of electrical potential, which bushings are connected to a high voltage winding in the assembly 18. A low voltage bushing structure is also provided, such as an insulating member 24 disposed to seal an opening in the tank wall through which a plurality of electrical conductors 26 pass. Conductors 26 are internally connected to a low voltage winding, or windings, and their external ends are adapted for connection to a load circuit outside of the transformer.

During the operation of electrical inductive apparatus 10, the electrical winding-magnetic core assembly 18 produces heat due to $I^2R$. Losses in the conductive turns of the windings, and core losses, which create a thermal gradient through the insulating liquid, with the higher temperature liquid being at the top of the liquid. The liquid 16 is cooled by a plurality of radiators or coolers 28, through which the liquid 16 circulates by the thermal syphon effect. Forced circulation by pumps are also possible. The radiators 28 are in fluid-flow communication with the liquid 16, such as by vertically spaced headers 30 and 32 which are welded to the tank wall, and a plurality of flat steel tubes 34 are welded between the headers. The warmer liquid 16 exits the tank near but below the level 14 of the liquid 16 via header 30, and it flows downwardly through the flattened tubes 34 into the lower header 32 which directs the cooled liquid 16 back into the tank 12. Thus, a continuous flow of cooled liquid 16 flows upwardly over and through the winding-core assembly 18 to remove the heat therefrom. The number of headers and tubes in the cooler 28 are selected according to the KVA rating and maximum temperature rise rating of the apparatus.

During the operation of oil-filled electrical apparatus, such as transformers, gases are generated from faults or failures in the apparatus. Electrical arcing and discharge, overheating, breakdown of cellulosic paper, heating of copper bus bars within the oil, are examples of means for contaminating the oil. There are several gases which may be found in the oil including hydrogen, compounds of carbon and hydrogen, carbon monoxide, carbon dioxide, nitrogen, oxygen, and argon, which have been detected in oil samples from electrical power transformers. Moreover, as the transformer ages, water is released into the dielectric fluid or oil. Finally, other contaminants such as insoluble particles including cellulose, copper, aluminum, and iron may gradually accumulate to an undesirable level, resulting in serious degradation of the dielectric liquid.

In accordance with this invention, filter means for removing such contaminants which comprise the enumerated gases, moisture, and insoluble particles are mounted on the tank 12. The means include a filter 40 external of the tank, for ease of replacement of the various filter cartridges.

As shown in FIG. 1, a filter 40 may be mounted in a fluid flow path which includes a housing 41 disposed between conduits 42, 44 which are in fluid flow communication with the dielectric fluid 16 within the tank 12. The filter 40 is preferably comprised of two portions 41 and 46 disposed in the circuit between the conduit 42, 44. Valves 48, 50, 52 are located such that the housings 41, 46 may be periodically removed for replacement or reconditioning without leakage of the liquid 16.

The housing 41 contains a degassing chamber in which filter means for degassing the liquid are disposed.

Such means comprise a permeation cell 54 having a permeable membrane of polymeric material which passes low molecular weight gases, such as hydrogen, carbon monoxide, and carbon dioxide, to reduce the contaminate gas content of the dielectric liquid. This can be constantly flushed with nitrogen, or it can be used to sample for contaminate gases, or it may be partially evacuated to reduce the total gas content of the oil on the other side of the membrane.

The housing 46 contains filter material 58 for demoisturizing the dielectric liquid 16. The material 58 is preferably comprised of a desiccant resin, such as a drying resin HCR-W2 as provided by the Dow Chemical Company of Midland, Mich. The resin is preferably in the form of granular pellets or solid spherical beads and is contained within a perforated canister 60 to facilitate insertion and removal for either regeneration or replacement. The resinous filter material 58 dries the dielectric liquid to 20 ppm or less of water at room temperature without depleting stabilizers or inhibitors.

The function of filtering the dielectric liquid 16 for removal of insoluble particles may be accomplished by the use of porous glass, clay filtration, or by packed resinous beads. A filter 62 for such particles is located at the lower end of the housing 46 below the canister 60. In an alternative the filter 62 may be included within the canister 60 with the desiccant filter material 58. Clay filtering comprises granular material. The filter 62 functions to remove such particles as dust, carbonaceous material, cellulose, products or decomposition of transformer components, or any solids resulting from initial manufacture and subsequent aging including metal particles, such as copper, aluminum, and iron. The filter function perferably reduces the content of such particles to a non-detectable range. The filter 62, whether separate or included with the canister 60, is removable for replacement as required. Circulation of the fluid through the filter 40 is preferably by a pump (P) or by the thermal syphon effect.

It is noted that although the foregoing order of the functions of degassing, dehumidifying, and filtering solid particles is set forth, any other order of the functions is feasible.

The following example is illustrative of the invention:

EXAMPLE

I. Evaluation of Extraction of Gases From Oil

Figure 2:
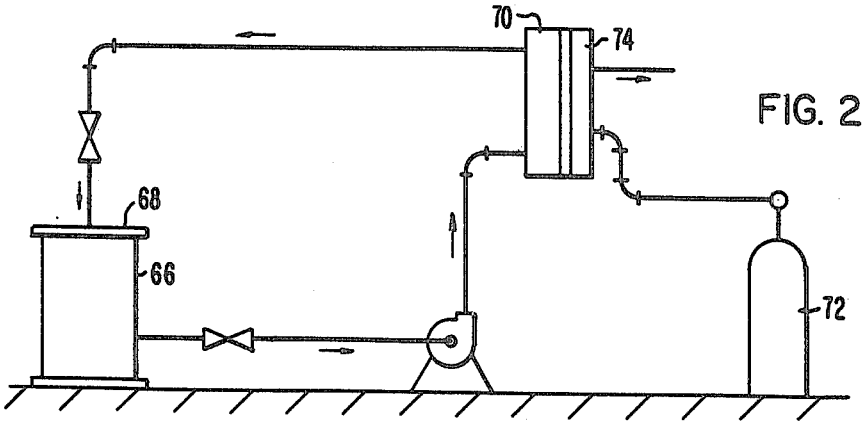
FIG. 2 is a schematic view of a laboratory setup for gas extraction experiments.

A study of gas extraction from transformer oil using a permeation cell was accomplished using a laboratory setup (FIG. 2). Approximately 2,000 ml of oil was placed in a stainless steel tank 66, which oil was saturated by bubbling through the oil for two hours a gas mixture as listed in Table I.

TABLE I

| Analysis of Gas Mixture Used to Saturate Oil | |
|---|---|
| Hydrogen | 0.47% |
| Oxygen | 3.71 |
| Carbon Monoxide | 4.10 |
| Methane | 1.01 |
| Carbon Dioxide | 4.07 |

After the two hour period, a tank top 68 was attached and nitrogen gas at 5 psig pressure was added to the head space above the oil. The oil was then pumped through the oil cavity side of a permeation cell 70 and back to the tank as indicated. Nitrogen gas in a container 72 was allowed to flow through the gas cavity side of the cell 70, thereby removing any gases that permeated through the polymeric membrane 74 of the cell.

Several hours after bubbling the gas mixture (Table I) through the oil, an oil sample was taken and analyzed for gas content using a gas chromatograph. The analysis was compared to the gas from the oil analysis obtained initially.

Table II contains the data from the experiments using the setup illustrated in FIG. 2.

TABLE II

| Study of Gas Extraction From Oil by Membrane | Gas Analysis | |
|---|---|---|
| | 10:00 A.M. Vol. (%) | 3:00 P.M. Vol. (%) |
| Nitrogen | 66.89 | 81.31 |
| Oxygen | 23.71 | 16.44 |
| Carbon Dioxide | 7.73 | 1.63 |
| Hydrogen | N.D. | N.D. |
| Carbon Monoxide | 6.29 | 0.42 |
| Methane | 1.37 | 0.20 |

The data of Table II indicates: the concentrations of all gases initially present, except for nitrogen, were markedly reduced after passing the oil through the permeation cell, the nitrogen content was increased due to the transfer of the purging gas (nitrogen) via the permeation cell into the oil. This causes no problem since nitrogen is normally present in the oil anyway due to transfer from the nitrogen blanket which is commonly used over the oil.

II. Evaluation of Removal of Water From Oil

This procedure involved passing a measured amount of water-doped oil through a measured amount of drying resin (HCR-W2) obtained from the Dow Chemical Company. Specifically, 10 grams of drying resin were used by placing in a glass column and 100 ml of oil was passed through the resin at a time. The oil flowed by gravity at a rate of 24–32 ml/minute.

The moisture content of the water-doped oil varied from 60–100 ppm. After passing a total of 5.3 gallons of oil through the same 10 grams of resin, the moisture content of the oil effluent was between 6–13 ppm. The 10 grams of resin were not regenerated during the experiment. The drying study was terminated at this point without the 10 grams of resin yet reaching its water saturation level.

III. Oil Compatability

A mixture of drying resin (Dowex HCR-W2) and oil was prepared in an 18:1 ratio (one liter of oil to 50 grams of resin). The systems were aged 7, 30, and 60 days at 105° C. and 125° C. Table III shows the oil properties for the resin and oil mixture and oil alone. The drying resin appears to have had no adverse effect on the oil during the study period.

TABLE III

| Exposure Time (Days) | Sample | Oil Properties After Aging in Presence of Dowex HCR-W2: Power Factor (%) | Color | Condition | Acid Number | IFT | Dielectric (Open Cup) (kV) |
|---|---|---|---|---|---|---|---|
| | | | | 105° C. | | | |
| 7[1] | Oil + Resin | 0.015 | L1.0 | Sediment[3] | 0.02 | 33.3 | 48, 41 |
| | Blank Oil | 0.016 | L1.0 | Clear[4] | 0.02 | 33.1 | 47, 50 |
| 30[2] | Oil + Resin | 0.005 | L0.5 | Clear[4] | 0.003 | 41.2 | 29, 31 |
| | Blank Oil | 0.04 | L2.5 | Clear[4] | 0.02 | 35.2 | 31, 22 |
| 60[2] | Oil + Resin | 0.005 | L0.5 | Clear[4] | 0.005 | 42.5 | 32, 46 |
| | Blank Oil | 0.04 | L0.5 | Clear[4] | 0.003 | 42.2 | 31, 34 |
| | | | | 125° C. | | | |
| 7[1] | Oil + Resin | 0.018 | L1.5 | Sediment[3] | 0.02 | 34.1 | 45, 54 |
| | Blank Oil | 0.058 | L3.0 | Clear[4] | 0.04 | 28.3 | 52, 42 |
| 30[2] | Oil + Resin | 0.005 | L0.5 | Clear[4] | 0.004 | 42.2 | 18, 22 |
| | Blank Oil | 0.04 | L0.5 | Clear[4] | 0.004 | 42.5 | 25, 27 |
| 60[2] | Oil + Resin | 0.01 | L0.5 | Clear[4] | 0.002 | 42.2 | 31, 28 |
| | Blank Oil | 0.01 | L0.5 | Clear[4] | 0.002 | 41.8 | 32, 30 |

[1]Screening Test, Glass Jars
[2]In Sealed Stainless Steel Tanks
[3]Resin Particles
[4]Oil Decanted from Test Tank In Table III the power factor is the ratio of the power dissipated in the oil in watts to the product of the effective voltage and current in volt amperes, when tested with a sinusoidal field under prescribed conditions. A high power factor value is an indication of the presence of contaminants or deterioration products.

The primary significance of color (Table III) is to observe a rate of change from previous samples of oil from the same transformer. Noticeable darkening in short periods of time indicate either contamination or deterioration of the oil. A darkening color, with no significant change in neutralization value or viscosity, usually indicates contamination with foreign materials. The color of an insulating oil is determined by means of transmitted light and is expressed by a numerical value based on comparison with a series of color standards.

Table III illustrates that even after 60 days at 125° C. the oil and resin system meets the specifications for new oil. For the "Acid Number" a low value is preferred. For the "IFT" and "Dielectric" columns, high values are preferred.

The advantage of the apparatus for continually upgrading transformer dielectric fluid of this invention is simplicity, low cost, adaptability to be mounted on a transformer or used as a separate unit. Moreover, oil flow can be carried out by either thermosyphon or a pump.

In conclusion, the apparatus of this invention includes the ability to use removable cartridges or canisters which both demoisturize, degas, and filter the oil by the use of resins in a continuous process, whereby the prior procedure of analyzing and then treating the oil to dehumidify and degas was required periodically under prior procedures which generally required the transformer to be out of service.

What is claimed is:

1. An apparatus for continually upgrading transformer dielectric fluid by degassing, demoisturizing, and filtering the fluid, comprising:

a tank, a dielectric fluid having a low vapor pressure disposed in the tank and containing contaminants including moisture, gases, and insoluble particulates, an electrical winding immersed within the fluid in the tank, filter means for decontaminating the fluid including a fluid recirculating device for degassing, demoisturizing, and filtering the fluid, the fluid recirculating device for degassing including a permeation cell having a membrane material and within a supportive container, the fluid recirculating device for demoisturizing including granular pellets of a desiccant material for reducing moisture in the fluid to 20 ppm or less at room temperature, whereby decontaminated fluid is returned into the tank.

2. The apparatus of claim 1 in which the dielectric fluid comprises a fluid selected from the group consisting of mineral oil, silicone fluids, higher molecular weight hydrocarbon, and mixtures thereof.

3. The apparatus of claim 1 in which the granular pellets include solid sphere-like beads.

4. The apparatus of claim 1 in which the desiccant pellets comprise a resinous material.

5. The apparatus of claim 4 in which the pellets of resinous material are contained in a fluid-pervious cartridge.

6. The apparatus of claim 1 in which filtering means for filtering the fluid comprises means for removal of insoluble particles in the fluid.

7. The apparatus of claim 6 in which the means for removal comprises porous glass.

8. The apparatus of claim 6 in which the means for removal comprises granular clay material.

9. The apparatus of claim 6 in which the means for removal comprises packed resinous beads.

* * * * *